US005403969A

United States Patent [19]

Muto

[11] Patent Number: 5,403,969

[45] Date of Patent: Apr. 4, 1995

[54] ELECTRONIC MUSICAL INSTRUMENT OF DELAYED FEEDBACK TYPE

[75] Inventor: Takaaki Muto, Hamamatsu, Japan

[73] Assignee: Yamaha Corporation, Japan

[21] Appl. No.: 271,570

[22] Filed: Jul. 7, 1994

Related U.S. Application Data

[63] Continuation of Ser. No. 740,993, Aug. 6, 1991.

[30] Foreign Application Priority Data

Aug. 9, 1990 [JP] Japan ..... 2-209248

[51] Int. Cl.[6] ..... G10H 1/14

[52] U.S. Cl. ..... 84/622; 84/624; 84/661; 84/DIG. 9; 84/DIG. 26

[58] Field of Search ..... 84/622, 624, 661, 659, 84/663, DIG. 9, DIG. 26

[56] References Cited

U.S. PATENT DOCUMENTS

| | | | |
|---|---|---|---|
| Re. 31,004 | 8/1982 | Niimi | 84/661 |
| 4,658,690 | 4/1987 | Aitken et al. | 84/DIG. 30 |
| 4,862,784 | 9/1989 | Kimpara | 84/622 |
| 4,907,484 | 3/1990 | Suzuki et al. | 84/661 |
| 4,909,120 | 3/1990 | Horiki et al. | 84/627 |
| 4,984,276 | 1/1991 | Smith | 381/63 |
| 5,157,218 | 10/1992 | Kunimoto et al. | 84/659 |

FOREIGN PATENT DOCUMENTS

| | | |
|---|---|---|
| 0248527 | 12/1987 | European Pat. Off. . |
| 58-58679 | 12/1983 | Japan . |
| 242491 | 2/1990 | Japan . |

*Primary Examiner*—William M. Shoop, Jr.
*Assistant Examiner*—Brian Sircus
*Attorney, Agent, or Firm*—Graham & James

[57] ABSTRACT

In a tone signal synthesizer for synthesizing a tone signal by supplying a driving signal, into a closed loop circuit including a delay circuit and a filter, a filter coefficient which controls the characteristic of the filter is changed while a musical tone is generated. For example, a set of filter coefficients are provided at the time of key-on and are switched to another set of filter coefficients when a predetermined time is passed after the time of key-on. The set of filter coefficients are switched to a further set of filter coefficients at the time of key-off and then are switched to a still further set of filter coefficients when a predetermined time is passed after the time of key-off. It is possible to generate a musical tone which changes more complexly on the basis of the change of the filter characteristic, with the passage of time.

8 Claims, 7 Drawing Sheets

ELECTRONIC MUSICAL INSTRUMENT OF DELAYED FEEDBACK TYPE

This is a continuation of application Ser. No. 07/740,993, filed on Aug. 6, 1991, now abandoned.

BACKGROUND OF THE INVENTION a) Field of the Invention

The present invention relates to a tone signal synthesizer employing a delayed feedback type tone signal synthesizing algorithm, in which a driving waveform signal is inputted into a closed loop containing a delay circuit and a filter and the driving waveform signal is circulated in the closed loop to synthesize a tone signal after waveform processing.

b) Description of the Prior Art

In a waveform read type tone signal synthesizer, tone signals different in pitch are synthesized by reading a fundamental waveform (for example, a sinusoidal waveform) at different reading velocity. Because the number of points sampled from the fundamental waveform decreases as the frequency increases, the characteristics of the synthesized tone signals deteriorate. Further, it is difficult to change the signal waveform with the passage of time.

Japanese Patent Publication (JP-B) No. Sho-58-58679 has proposed a technique in which a driving waveform signal is inputted into a closed loop formed by connecting a filter and a delay circuit and the driving waveform signal is repeatedly circulated in the closed loop so that a tone signal is synthesized. The total delay time of the closed loop determines the repetition frequency. The characteristic of the filter determines frequency distribution of the signal characterizing the musical tone. According to this technique, the amplitude, high-frequency content, high-frequency phase, etc. of the signal can be changed widely with the passage of time, so that musical tones more perfectly approaching the musical tones of natural musical instruments can be generated compared with the waveform read type tone signal synthesizer.

In the conventional tone signal synthesizing technique, however, the synthesized musical tone is still not very rich in variation compared with the musical tone of a natural musical instrument, failing to attain a desired effect.

SUMMARY OF THE INVENTION

An object of the present invention is to provide a tone signal synthesizer employing a delayed feedback type tone synthesizing algorithm, for synthesizing a musical tone which is rich in variation as to be comparable to the musical tone of a natural musical instrument.

Another object of the present invention is to provide a tone signal synthesizer for an electronic musical instrument which can respond to fine manipulation by a performer.

According to an aspect of the present invention, there is provided a tone signal synthesizer comprising: a closed loop including a delay means and a filter means; means For inputting a driving waveform signal into said closed loop; means for extracting an output signal from said closed loop; and a filter characteristic control means for variably setting the characteristic of said filter means.

In an embodiment of the present invention, the filter characteristic control means changes the characteristic of the filter means corresponding to the time length passed after the time of key-on or after the time of key-off.

In the conventional tone synthesizing technique, a filter is used as means for attaining the frequency characteristic characterizing a musical tone. The characteristic of the filter is, however, fixed for each tone color. In a natural musical instrument, however, the frequency characteristic of a vibration system changes at various points within generation of the musical tone.

For example, the decay characteristic of the piano has a feature generally called a double decay phenomenon. In the piano two or three strings are used for most of the tones. This structure causes a phenomenon that the tone volume decays at a relatively large rate after the key depression, and when the tone volume has reached a certain level, the tone volume then decays at a smaller rate than before. In the conventional filter circuit, only one filter coefficient can be set. Thus, the double decay phenomenon is hardly simulated in the conventional electronic musical instrument.

In the piano, key depression is performed through driving a hammer covered with hard felt. When a key depression is made, the generated tone displays the double decay as mentioned above due to a plural strings for a tone. Here, the amount of decay is faster in high frequency tones. That is, the piano has a function like a low pass filter. When key release is made, the decay of the tone is achieved by a damper. The damper of the piano is covered with felt, and the felt performs a faction of mechanical low pass filter. This decay after key release is faster than the faster decay of the double decay phenomenon after key depression. Thus, there are decays after key depression and after key release, which can fundamentally be simulated by a low pass filter, the characteristic of the low pass filter is different for the key depression phenomenon and the key release phenomenon. Accordingly, the change of the musical tone in the natural musical instrument cannot be reproduced by the conventional technique using such a characteristic-fixed filter.

According to an aspect of the present invention, the filter characteristic can be set at the time of key-on and at the time of key-off independently of each other, so that it is possible to synthesize a musical tone which is different in tone color, amplitude and manner of changes thereof between the case of key-on and the case of key-off, and which more resembles the musical tone of the natural musical instrument.

A musical tone which changes the characteristic with time, resembling the musical tone of the natural musical instrument, can be synthesized by changing the filter characteristic corresponding to the time passed after the time of key-on or after the time of key-off.

The musical tone can be changed corresponding to the performer's fine control by changing the filter characteristic in response to the touch at the time of key-on or at the time of key-off. An electronic musical instrument responsive to the performer's fine control can be provided by using such a tone signal synthesizer.

DESCRIPTION OF THE PREFERRED EMBODIMENTS

Embodiments of the present invention will be described hereunder by reference to the drawings.

Figure 7:
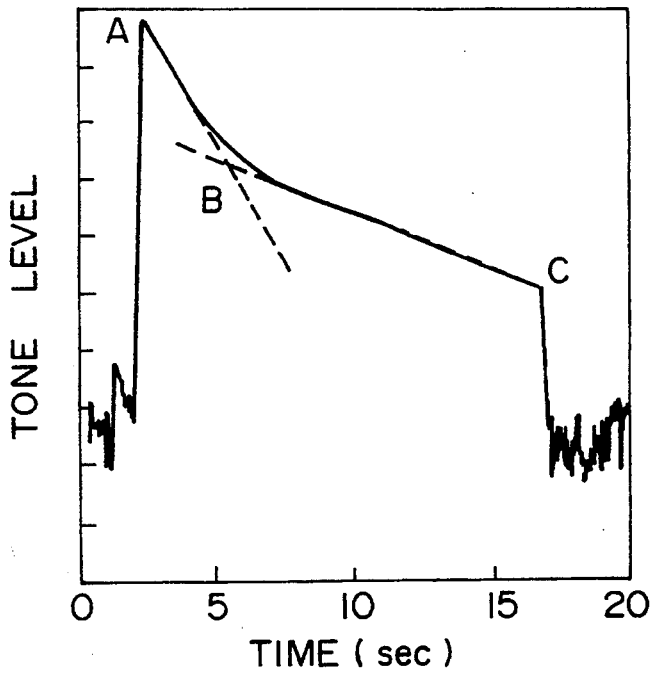
FIG. 7 is a graph showing a tone envelope of a piano sound generated from a natural musical instrument piano.

FIG. 7 shows an example of a piano tone envelope. When a key in the piano is depressed, the tone level rises rapidly to a level corresponding to the depressing key touch, then decays relatively rapidly from point A to point B, and then decays relatively gradually from point B to point C. When the key is released at point C, the tone level decays more rapidly than the rapid decay portion A-B upon key depression. In short, there are three decay rates, two after key depression and one after key release. FIG. 7 shows this three stage variation of the tone level. The frequency characteristic of the tone is expected to have similar three stage variation, corresponding to the time shortly after the key depression, a more extended time after key depression, and after key release.

Figure 1:
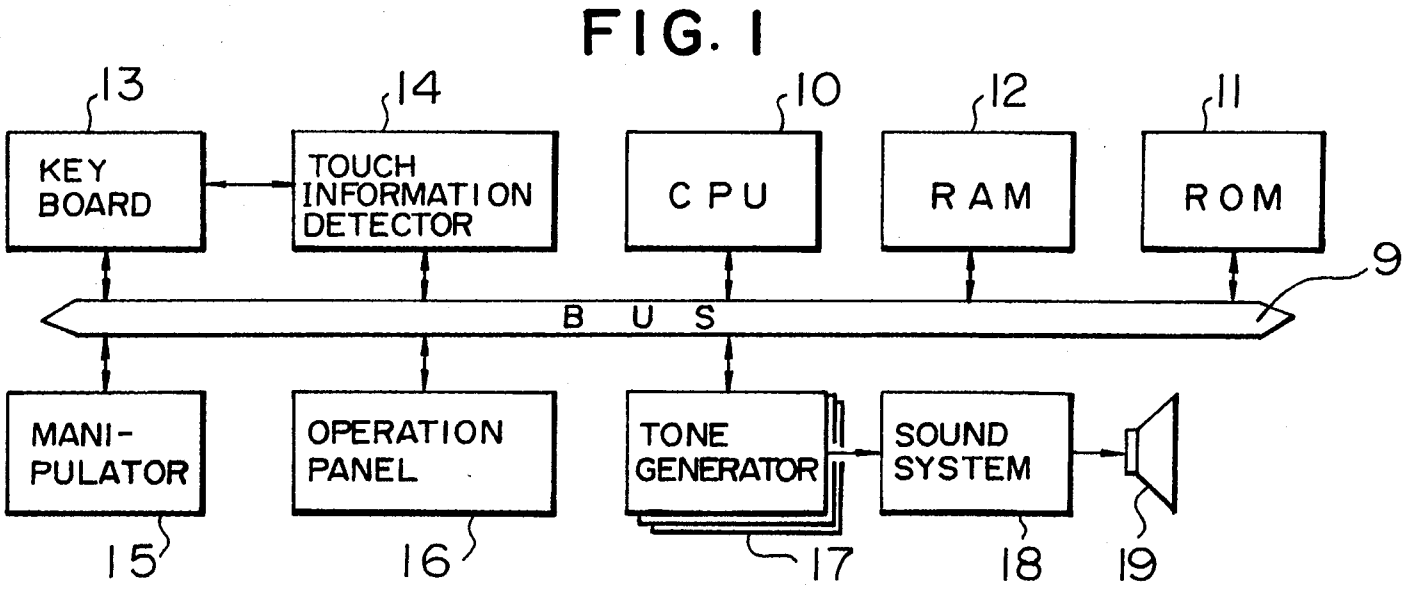
FIG. 1 is a block diagram showing the whole configuration of an electronic keyboard instrument according to an embodiment of the present invention.

FIG. 1 is a block diagram showing the whole configuration of an electronic keyboard instrument according to an embodiment of the present invention.

In the electronic keyboard instrument, the operation thereof is generally controlled by a central processing unit (CPU) 10. A read-only memory (ROM) 11, a random access memory (RAM) 12, a keyboard circuit 13, a touch information detection circuit 14, various types of manipulators 15, an operation panel 16 and a tone generator circuit 17 are connected to the CPU 10 through a two-directional bus line BUS 9. A sound system 18 including an analog-to-digital (D/A) converter and a power amplifier is connected to the tone generator circuit 17. A speaker 19 is connected to the sound system 18. The CPU 10 has a running counter for continuously counting predetermined clock pulses.

In FIG. 1, a program area and a parameter area are provided in the ROM 11. Various control programs for executing flow charts as shown in FIGS. 3 through 6 (which will be described later) are stored in the program area. In the electronic keyboard instrument, a musical tone to be generated is changed corresponding to the information whether it is key-on or key-off, the key touch information (initial key touch) at the time of key-on and the key touch information (release key touch) at the time of key-off, as well as the selected tone color. Further, the musical tone to be generated is also changed when a predetermined time is passed after the key-on or after the key-off. The change of the musical tone is attained by controlling the filter coefficient or factor of a filter circuit included in the tone generator circuit 17 which will be described later. Filter coefficients corresponding to tone color information, key touch information, information whether it is key-on or key-off and information whether a predetermined time has passed are stored as a table in the parameter area of the ROM 11. In particular, a filter coefficient having influence mainly on the frequency characteristic without particular decay of the musical tone is stored as a filter coefficient at the time of initial touch, whereas a filter coefficient not only having influence on the Frequency characteristic but making the musical tone decay gradually is stored as a filter coefficient at the time of release touch.

Registers, flags, etc. for temporarily storing various kinds of data generated when the CPU 10 executes the control programs are provided in the RAM 12. Hereinafter, the registers, flags, etc. and the contents thereof are represented by like labels.

The keyboard circuit 13 has key switches corresponding to keys in a keyboard. The keyboard circuit 13 generates a key code KC representing the operated key, a key-on signal KON representing the state of key depression and a key-off signal KOFF representing the state of key release.

The touch information detection circuit 14 detects the key depression speed or key release speed of a key switch corresponding to the key operated in the keyboard and generates initial touch information expressing the key depression speed and release touch information expressing the key release speed.

Pedals such as a damper pedal, etc. provided in an ordinary piano are used as the various kinds of manipulators 15.

Tone selection switches, volume switches, various effect selection switches, etc. are provided in the operation panel 16.

The tone generator circuit 17 synthesizes a musical tone signal on the basis of tone control information given from the CPU 10 corresponding to the operating and setting condition of the various kinds of manipulators 15 and the operation panel 16 and the keyboard operation. The musical tone signal is supplied to the loud speaker 19 through the sound system 18 and converted into a sound which is radiated through the loud speaker 19.

The tone generator circuit 17 has a plurality of channels (for example, 16 channels) for generating a plurality of tones (for example, 16 tones) simultaneously. The plurality of channels in the tone generator circuit 17 may be provided by physical means or may be provided by software or hardware time sharing means.

Figure 2:
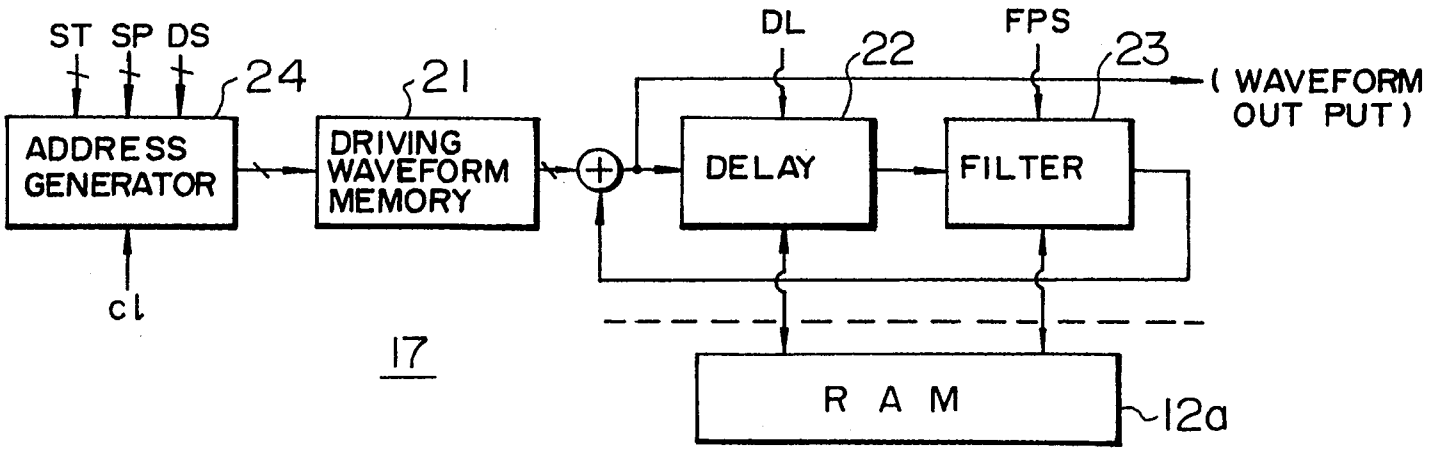
FIG. 2 is a block diagram showing the tone generator circuit depicted in FIG. 1 more in detail.

FIG. 2 shows the detail of one channel of the tone generator circuit 17 depicted in FIG. 1.

The tone generator circuit 17 introduces a driving waveform read from a driving waveform memory 21 into a closed loop including a delay circuit 22 and a filter circuit 23 to thereby generate a musical tone signal. The total delay length of the closed loop corresponds to the pitch of the musical tone to be outputted. The filter characteristic thereof corresponds to the frequency characteristic (tone color) of the musical tone.

An address from an address generator 24 is used for reading the driving waveform. The CPU 10 (FIG. 1) gives the driving waveform read start point SP and the read data size DS to the address generator 24. Further, the delay length DL for the delay circuit 22, the filter parameters FPS for the filter circuit 23, etc. are inputted into the tone generator circuit 17 from the CPU 10.

In FIG. 2, RAM 12*a* is part of the RAM 12 depicted in FIG. 1. The RAM 12*a* is used for temporarily storing data generated in the delay circuit 22 and the filter circuit 23.

In the electronic keyboard instrument, filter coefficients corresponding to the touch and the key code are given when a key is depressed. When the key depression is continued, at least one different filter coefficient is given after a predetermined time depending on the key code or the like is passed. When the key is then released, at least one further different filter coefficient is given. When a predetermined time depending on the key code or the like is passed after the key release, at least one further different filter coefficient is given. As a result, a complex Frequency characteristic which changes in time as seen in a natural musical instrument can be provided.

Figure 8:
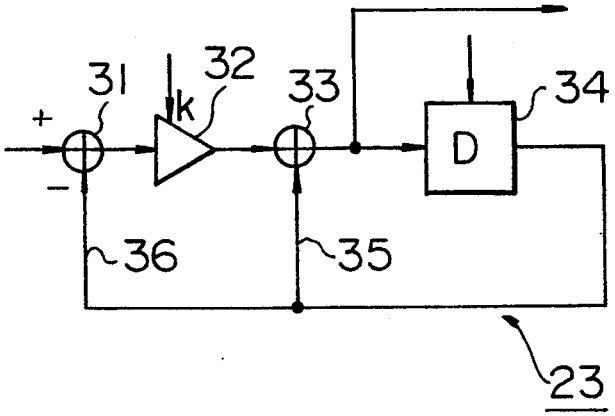
FIG. 8 is an example of the filter circuit.

FIG. 8 shows art example of the filter circuit 23. An adder 31, an amplifier 32, an adder 33, a delay stage 34 are connected in series. The output of the delay stage 34 is fed back to the adder 31 in opposite phase and to the adder 33 in phase. The amplifier 32 amplifies an input signal depending on the filter coefficient k which is supplied from the external. The delay stage 34 delays an input signal depending on a filter coefficient D which is supplied from the external. The output signal of the loop circuit is taken out at output of the adder 33. A linear low pass filter (LPF) is formed by such construction. Inserting a LPF in the loop circuit in which the signal circulates, high frequency components of the circulating signal are largely decayed compared with low frequency components.

The transmission function of this linear LPF is expressed as $$H(s)=k/(s+k).$$

Expressing this equation, in digital form by Z transformation, there is provided, $$H(Z)=k/\{1-exp(-k)Z^{-1}\}.$$

Here, $k=2\pi f_0/f_5$, $F_5$ the sampling frequency, and $f_0$ is the cut off frequency.

Employing an approximation of $\exp(x)=1+x$, H(Z) can be expressed as, $$H(Z)=k/\{1-(1-k)Z^{-1}\}.$$

For example, when the amplification factor k of the amplifier 32 in the circuit of FIG. 8 is changed, the cut off frequency $f_0$ of the filter can be adjusted through the relation of $k=2\pi f_0/F_S$.

Figure 9:
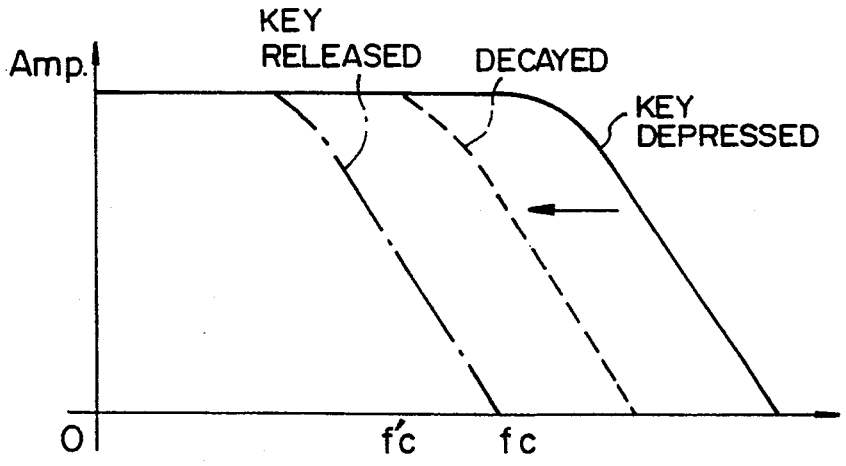
FIG. 9 is a graph showing the frequency distribution of the filter transmission output.

FIG. 9 shows frequency distribution of the filter transmission output when the cut off frequency of the filter is changed. Tile change of the cut off filter can be achieved by varying the filter coefficient k. When the cut off frequency is lowed, the higher harmonics above the out off frequency are significantly decayed.

Figure 10:
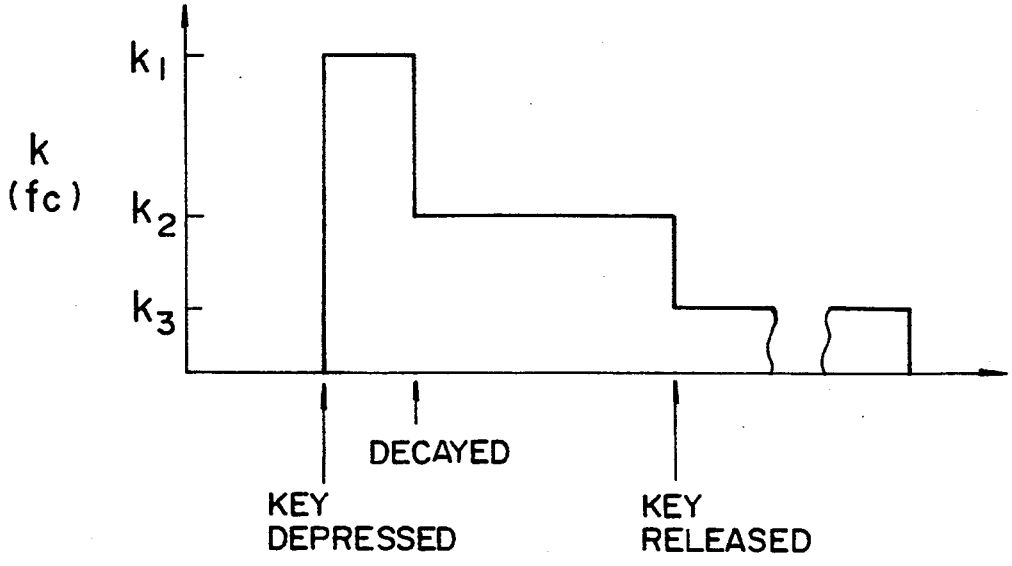
FIG. 10 is a graph showing time variation of the filter coefficient.

FIG. 10 shows time variation of the filter coefficient, and hence the cut off frequency. Upon key depression, the filter coefficient k is set at a high value k1, and after the laps of a predetermined time, the filter coefficient k is lowed to a intermediate value k2 in synchronism with the decay of the amplitude. When the key is released, the filter coefficient k is further lowed to a low value k3. By such change of the filter coefficient, high Frequency components of the signal are significantly varied.

Variations of the filter coefficients are set depending on, for example, the key code KC and the touch data.

In the following, the operation of the CPU 10 in the electronic musical instrument in FIG. 1 is described with reference to the flow charts of FIGS. 3 through 6.

When the electronic musical instrument is powered on, the CPU 10 starts its operation according to a control program stored in the ROM 11. First, in step S101, initialization is made so that the RAM 12 is cleared. Then, a circulatory process of the steps S102 to S108 is carried out.

In the circulating process, the output of the keyboard circuit 13, the output of the various manipulators 15 and the output of the operation panel 16 are examined respectively in steps S102, S104 and S106. When the change (key event) of the state of a key in the keyboard is detected in the step S102, the procedure goes to step 103 from step S102. After the key event process (FIG. 4) is carried out in step S103, the procedure goes to the step S104. When, on the other hand, there is no key event detected, the situation of the procedure skips over the step S103 and directly goes to step S104 from step S102.

When the change of the state of a manipulator (manipulator event) is detected in step S104, the procedure goes to step S105 from step S1O4. After the manipulator event process (FIG. 6) is carried out in step S105, the procedure goes to step S106. When, there is no manipulator event detected, the procedure skips over step S105 and directly goes to step S106 from step S104.

When the change of the state of the panel (panel event) is detected in step S106, the procedure goes to step S107 from step S106. After the panel event process (in which the tone color register or the like is set corresponding to the state of the panel) is carried out in step S107, the procedure goes to step S108. When there is no panel event detected, the procedure skips over step S107 and directly goes to the step S108 from step S106.

Figure 5:
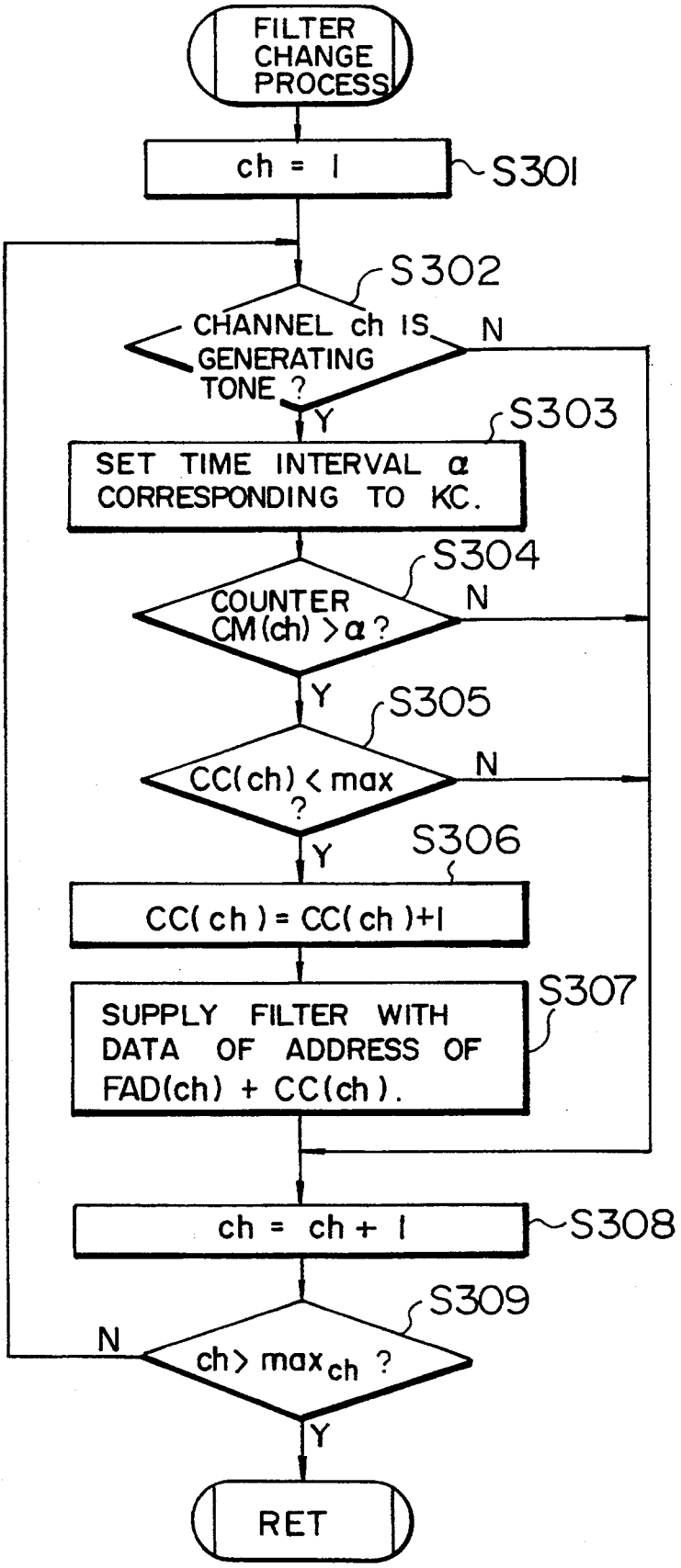

When the filter changing process shown in detail in FIG. 5 is carried out in step S108, the situation of the procedure goes back to step S102 to repeat the circulatory process of steps S102 to S108.

Figure 3:
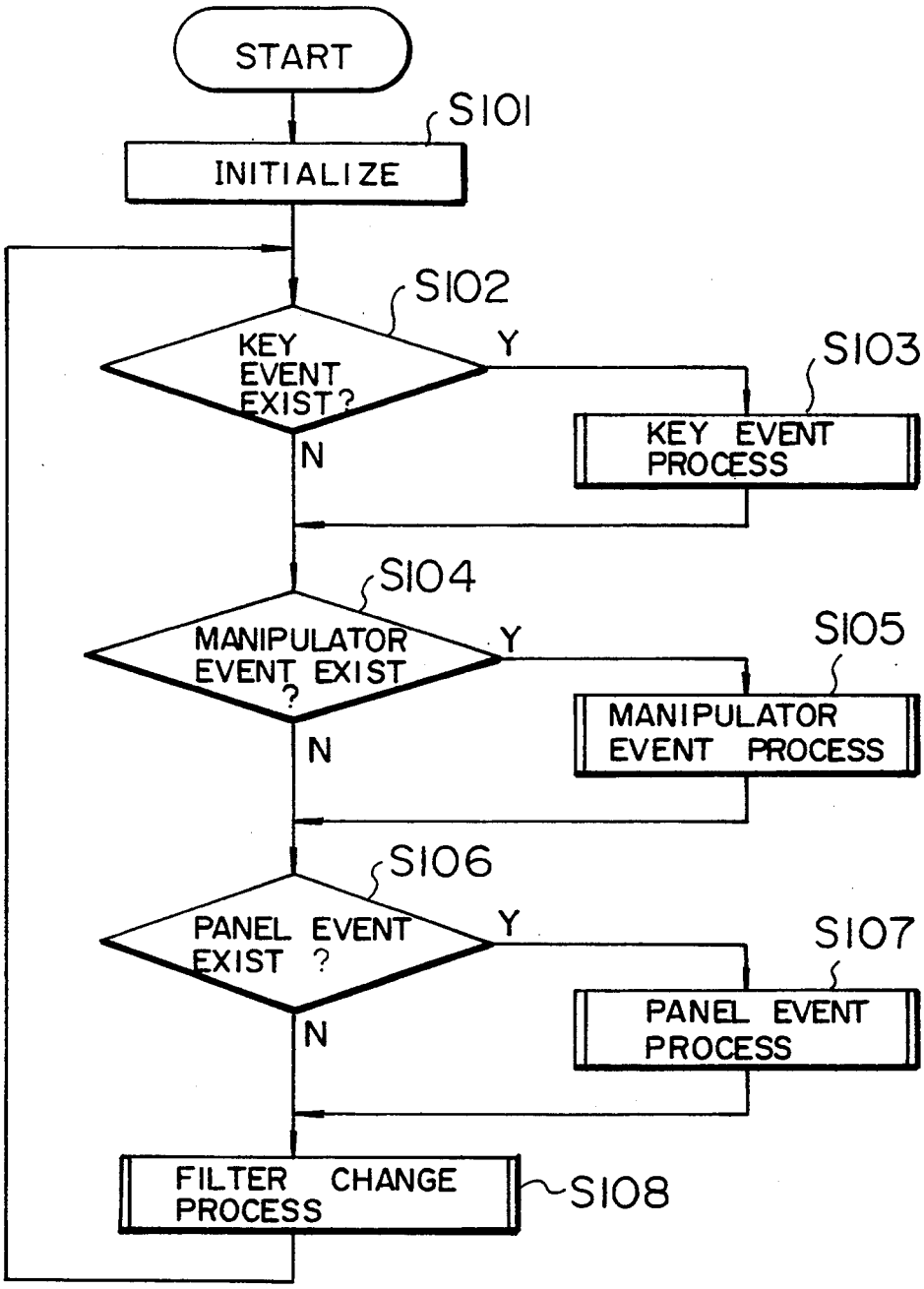
FIGS. 3 through 6 are Flow charts showing the processing executed by the CPU depicted in FIG. 1.
Figure 4:
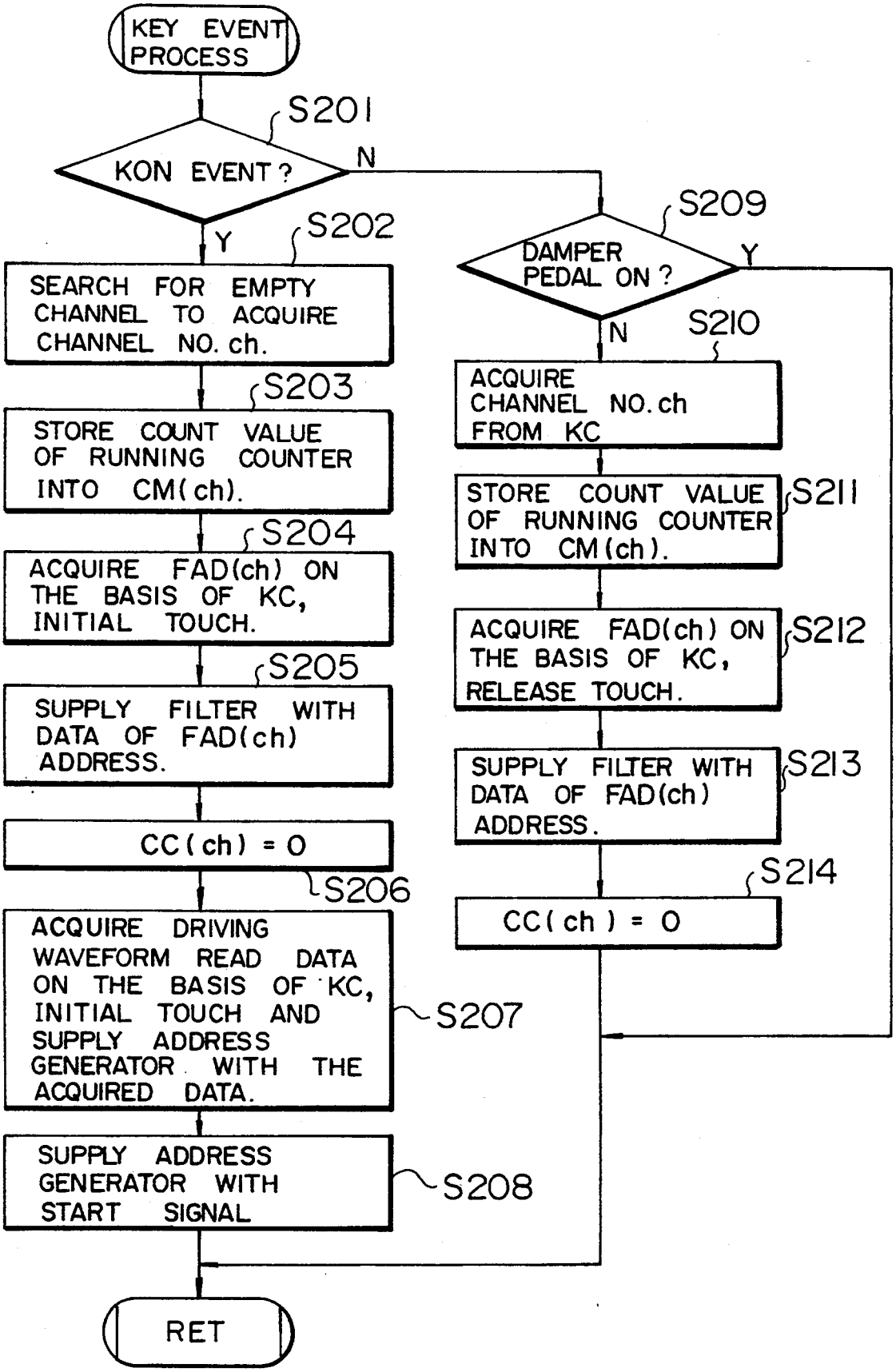

When the presence of a key event is detected in step S102 in the circulatory process of steps S102 to S108 shown in FIG. 3, the CPU 10 carries out the key event process of FIG. 4 in step S103.

Referring to FIG. 4, a discrimination is made in step S201 whether the key event is a key-on event or not. When the key event is a key-on event, an empty or idle channel is searched for in step S202 to thereby acquire the channel number ch of the empty channel. In this embodiment, one empty channel number ch is acquired among the 16 channels. If all the 16 channels are operating, a truncation process which is known in the prior art is carried out. For example, a tone having the most progressed decay is erased so that the channel of this tone is prepared as an empty channel.

In next step S203, the value of the running counter is stored in a counter memory CM(ch). The counter memory CM(ch) is a register provided for each channel to store the value of the running counter of the channel ch. The counter memory CM(ch) is used to detect the time passed after the point of time of key-on or key-off in the channel ch on the basis of the present value of the running counter to thereby change the filter coefficient (see steps S304 and S307 in FIG. 5 which will be described later).

In step S204, an address FAD(ch) in the filter coefficient memory is acquired on the basis of the key code KC, the initial touch information, etc.

At least one filter coefficient may be varied depending on the lapse of time. For example, in the loop circuit shown in FIG. 8, the amplification factor k of the amplifier may be varied depending on the lapse of time as follows.

| Upon key depression and decay | | |
|---|---|---|
| KC | initial touch | filter coeff. k |
| A0 | strong: S | k (A0, S, 0) |
| | | k (A0, S, 1) |
| C4 | strong: S | k (C4, S, 0) |
| | | k (C4, S, 1) |
| | medium: M | k (C4, M, 0) |
| | | k (C4, M, 1) |
| D4 | weak: W | k (C4, W, 0) |
| | | k (C4, W, 1) |
| | strong: S | k (D4, S, 0) |
| | | k (D4, S, 1) |
| | medium: M | k (D4, M, 0) |
| | | k (D4, M, 1) |
| C8 | weak: W | k (C8, W, 1) |

| Upon Key Release | | |
|---|---|---|
| KC | release touch | filter coeff. k |
| A0 | strong: S | k (A0, S, 2) |
| | medium: M | k (A0, M, 2) |
| | weak: W | k (A0, W, 2) |
| B0 | strong: S | k (B0, S, 2) |
| | medium: M | k (B0, M, 2) |
| B3 | weak: W | k (B3, W, 2) |
| C4 | strong: S | k (C4, S, 0) |
| | medium: M | k (C4, M, 0) |
| | weak: W | k (C4, W, 2) |
| D4 | strong: S | k (D4, S, 2) |
| | medium: M | k (D4, M, 2) |
| | weak: W | k (D4, W, 2) |
| C8 | medium: M | k (C8, M, 2) |
| | weak: W | k (C8, W, 2) |

The above tables show the variations of the filter coefficient k which is supplied to the amplifier 32 of FIG. 8. Another filter coefficient D in the delay stage 34 may also be varied to realize more complex time variation. It will be apparent that when another type of filter circuit is employed, another filter coefficient or coefficients may be varied depending on time.

The filter address FAD(ch) may be found by reference to a table or by calculation on the basis of the respective parameters (key code KC, initial touch information, and the like). In the case where the filter address is found by reference to a table, the filter address FAD(ch) reference table can be prepared in the ROM 11. In this embodiment, filter coefficients to be read in time sequence are sequentially stored in the found address FAD (ch).

The filter coefficient may be directly calculated from other performance parameters. For example, the filter coefficient k in the circuit of FIG. 8 can be expressed as $$k=2\pi f_0/F_S.$$

The cut off frequency of the low pass filter is related with the tone pitch of each key. Let the fundamental frequency of the tone for the key code KC be denoted as f(KC) and the cut off frequency of the low pass filter as n times the fundamental frequency, $$k=2\pi n \cdot f(KC)/F_S.$$

Upon key on, for generating waveforms including much high frequency components, the cut off frequency is set high. The number n is thus set high, for example 8, to generate much higher harmonics. When a certain time has passed after key-on, the number n is altered to a smaller value, for example 4. In such a way, the filter coefficient may be obtained without referring to the table. Here, $F_S$ denotes the sampling frequency of, for example 50 KHz, which is fixed.

When, for example, a natural musical instrument is played by strong touch, the out, put musical tone includes lots of high-frequency components. To simulate this phenomenon, coefficients are given to change the degree of decay in the high pitch region corresponding to the intensity of the initial touch. With respect to the key code KC, filter coefficients are given to attain the difference (for example, heavy tone, light tone, etc.) in tone generating characteristic in the musical instrument in each pitch region.

In step S205, filter coefficients stored in the filter address FAD(ch) are actually outputted to the filter circuit 23.

In step S206, the change count register CC(ch) is cleared. The change count register is a register for storing the number of time of switching the filter coefficients.

In this embodiment, a set of filter coefficients are switched to another set of filter coefficients when a predetermined time is passed after the point of time of key-on or key-off. The number of times of switching the filter factors is not limited to one but may be set, suitably, to two or more.

The number of sets of filter coefficients repaired in the table in the ROM 11 for one key-on or key-off is finite (in this embodiment, two sets are provided for each of key-on and key-off: in general, the number of sets is 1 plus the number of time of switching). Therefore, in this embodiment, the carried-out number of time of switching the filter coefficients is stored in the change count register CC(ch) so that filter factors cannot be switched any more after the prepared sets of filter factors are switched (see step S305 in FIG. 5 which will be described later).

In step S207, the data of the starting point SP and the data size DS expressing a region of driving waveform data stored in the inside of the driving waveform memory 21 corresponding to the key code KC and the initial touch are acquired and supplied to the address generator 24 (FIG. 2). These data SP and DS may be acquired by reference to a table or by calculation in the same manner as described above in step S204.

In step S208, a starting signal ST is supplied to the address generator in FIG. 2 to give an instruction to start the synthesizing of a musical tone. In response to the starting signal, a driving waveform is read out. When the process of the step S208 is finished, the procedure goes back to the initial process (step S104 in FIG. 3).

When, the result of step S201 is "NO", that is, when the generated key event is not a key-on event, the key event is a key-off event. In this case, the situation of the procedure goes to seep S209 from step S201.

In step S209, a judgment is made whether the damper pedal is on or not. In general, all hammers are released when the damper pedal of a piano is pushed, so that a special sound effect is attained. In tills embodiment, if the damper pedal is on when a key is released, the generation of the musical tone is continued without decay of the musical tone in the same manner as in the case where the sustain pedal is on. If the damper pedal is off when a key is released, the musical tone is decayed rapidly in the same manner as in the case of a damper.

The judgment in step S209 is to attain the difference between the case where the damper pedal is on and the case where the clamper pedal is off. If the damper pedal is on, that is, if the clamper pedal is pushed down, the procedure skips over steps S210 through S214 and goes; back to the initial process (step S104 in FIG. 3) from step S209. That is, if the damper pedal is pushed down, the key-off is neglected so that nothing is done regardless off the key-off.

If, the damper pedal is off, the musical tone is damped at the time of the key-off. That is, if the damper pedal is off at the time of the key-off, the result of the judgment in step S209 is "NO" and then the procedure goes to step S210. In step S210, the channel ch assigned for the key code KC of the released key is acquired.

In step S211, the value of the running counter is stored in the counter memory CM(ch) in the same manner as in step S203. In step S212, an address FAD(ch) in a region in which filter coefficients corresponding to the key code KC and release touch are stored is acquired on the basis of the key code KC and the release touch. Accordingly, the difference in the musical tone between the case where the key is released rapidly and the case where the key is released slowly can be attained. After process similar to that in steps S205 and S206 is carried out in steps S213 and S214, the procedure goes back to the initial process (step S104 in FIG. 3).

When a predetermined time is passed after the point of time of key-on or key-off in the electronic keyboard instrument in FIG. 1, the passage of time is detected in step S108 in FIG. 8 to switch the set of filter coefficients to another set of filter coefficients.

FIG. 5 shows the detail of the filter changing process in step S108. In the loop process of steps S302 to S309 in FIG. 5, some channel in which a predetermined time has been passed after the point of time of key-on is retrieved by scanning all channels (ch=1 to 16).

Referring to FIG. 5, in step S301, in a search channel number storage register, the channel number ch is set to 1 for the purpose of scanning all channels in order from No. 1 channel (ch=1).

In step S302, a judgment is made whether the channel ch is currently used for tone generation. If the channel is not used for tone generation, the procedure skips over steps S303 through S307 and goes to step S308 to examine the next channel.

In this electronic keyboard instrument, the musical tone output can be continued even after the key is released because of the presence of the damper pedal. Therefore, the judgment in step S302 is not based on information whether the key-on flag is set or not, but based on information whether the channel is currently used for tone generation.

When a decision is made in step S302 that the channel ch is currently used for tone generation, the situation of the procedure goes to the step S303. In step S303, the time interval a is determined corresponding to the key code KC. When the value of the running counter exceeds the time interval $\alpha$, another set of filter coefficients FPS is given to the filter circuit 23.

In an ordinary natural musical instrument, the musical tone waveform changes more rapidly as the pitch becomes higher, because the duration of the musical tone becomes shorter as the pitch becomes higher. In this embodiment, the time interval a for changing filter coefficients is not set constant in the whole key region but set variable corresponding to the key code KC (key scaling), to thereby attain the change of the musical tone which resembles that of the natural musical instrument more faithfully.

In step S304, the time passed after the point of time of key-on, key-off or damper-off is detected by subtracting the previous value of the running counter stored in the counter memory CM(ch) at the time of key-on, key-off or damper-off from the present value of the running counter, so that judgment is made whether the passed time is larger than the time interval $\alpha$ or not.

When the passed time is not longer than the time interval $\alpha$, the procedure goes to step S308 to apply the process to the next channel because the predetermined time a is not yet passed after the point of time of key-on, key-off or damper-off. When, the passed time is longer than the time interval $\alpha$, the procedure goes to step S305 to switch the filter coefficients because a filter coefficients switching point has come.

In step S305, judgment is made whether the change count CC(ch) reaches its maximum max or not. The change count CC(ch) expresses the number of time of changing the filter coefficients for each channel. Accordingly, the change count CC(ch) is initially zero when this routine is started. In this embodiment, the maximum max thereof is set to 1.

When the change count CC(ch) does not reach the maximum max, the procedure goes to the step S306. When, the change count CC(ch) reaches the maximum max, that is, when the predetermined number max of filter coefficient switching operations are finished, the procedure goes to step S308 because the filter coefficient switching operation is required no more.

In step S306, the change count CC(ch) is increased by one. Because the value of the change count CC is either 0 or 1 in this embodiment, the value of the change count CC in this routine may be set to 1. The routine shown in FIG. 5 can be applied generally to the case where a plurality of filter coefficient sets are provided for each channel.

In step S307, data in the FAD(ch)+CC(ch) address is read out and used as-the next filter coefficient to be given to the filter circuit 23. In this embodiment, the address may be also expressed by FAD+1. The time-series change of the filter coefficient decided on the basis of the touch, key code KC, etc. is sequentially stored in the memory.

In step S308, the channel number ch is increased by one to search for the next channel. In step S309, judgment is made whether the channel number ch reaches the maximum channel number $max_{ch}$ or not. When the channel number ch is smaller than its maximum $max_{ch}$, the procedure goes back to step S302 to repeat the process of steps S302 to S308. When, the channel number ch reaches its maximum $max_{ch}$, the procedure goes back to initial process (step S102 in FIG. 3) because the searching of all channels from the channel number 1 to the channel number $max_{ch}$ is finished. In this embodiment, the maximum channel number $max_{ch}$ is 16, because the tone generator circuit has 16 channels as described above.

Figure 6:
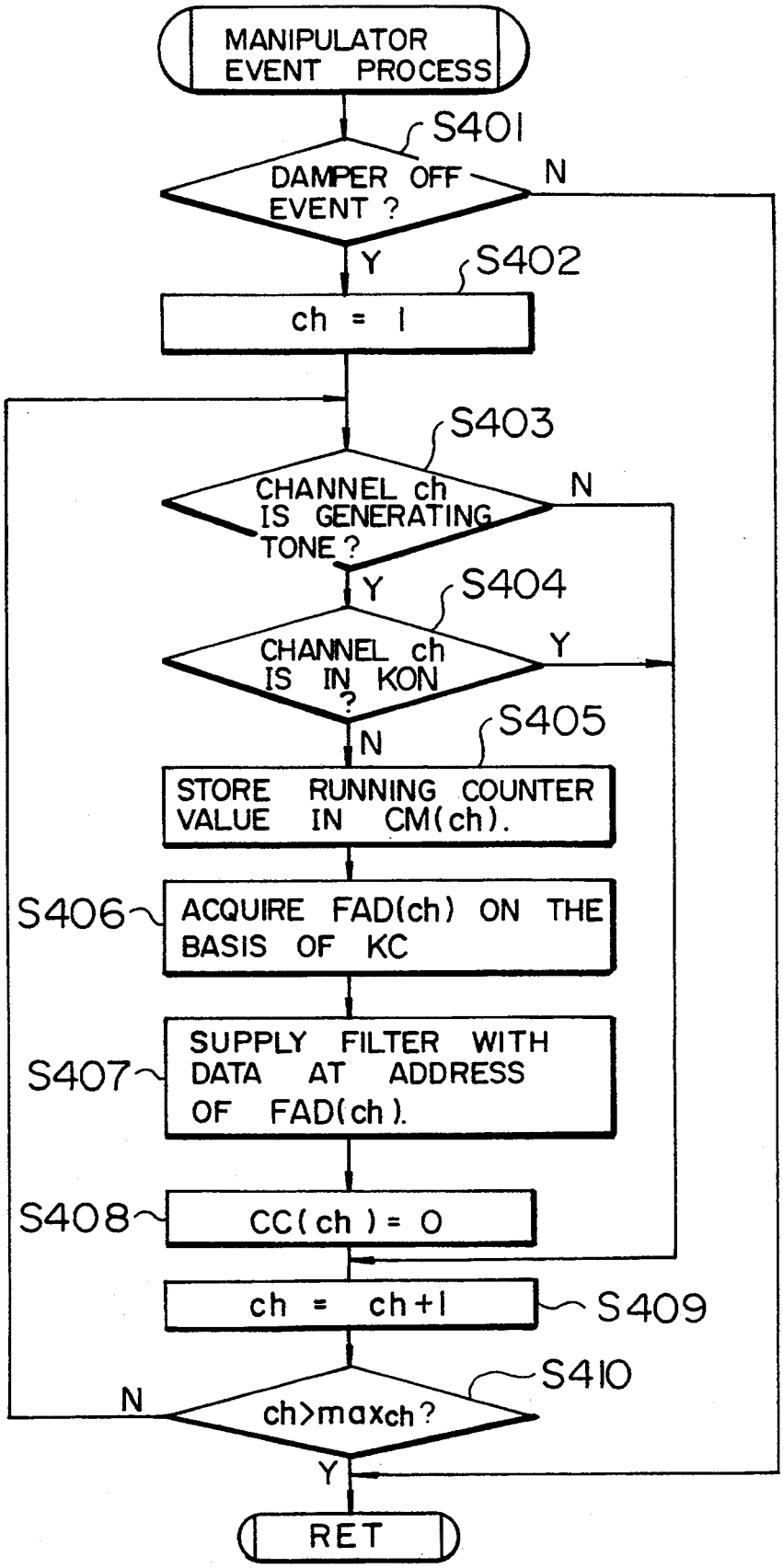

When the presence of a manipulator event is detected in step S104 in the circulatory process of steps S102 to S108 in FIG. 3, the CPU 10 in FIG. 1 carries out the manipulator event routine of FIG. 6 in step S105.

The manipulator event routine is a routine for forcedly carrying out a key-off process when damper pedal-off occurs for a key not subjected to the key-off process because of the occurrence of damper pedal-on regardless of the occurrence of key-off.

Referring to FIG. 6, in step S401, judgment is made whether the manipulator event is a damper-off event or not. In this embodiment, a damper-on event is not particularly considered. When the manipulator event is a damper-off event, the musical tone in the channel in which the key is currently off but the musical tone output is continued is decayed.

That is, after the channel number ch is set to the initial value 1 in step S402, judgment is made in step S403 whether the channel ch is used for tone generation. When the channel is not used for tone generation, the procedure goes to step S409 because the forcedly key-off process is unnecessary.

When, the channel is used for tone generation, judgment is made in step S404 whether the channel ch is in key-on or not. When the channel is in key-on, the situation of the procedure goes to step S409 because there is no necessity of forcedly decaying the musical tone by the key-off process regardless of the operation of the damper pedal. When the channel is not in key-on, the procedure goes to step S405.

The process of steps S405 to S408 is carried out in the same manner as that of steps S203 to S206, except that FAD is acquired only by the key code in step S406 because there is no touch information in the damper pedal.

That is, in step S405, the value of the running counter is stored in the counter memory CM(ch). In the step S406, the address FAD in which the filter coefficient is stored is acquired on the basis of the key code KC. In step S407, the filter coefficient stored in the filler address FAD(ch) is outputted to the filler circuit 23. In step S408, the change count register CC(ch) is cleared.

The process of the following steps S409 and S410 is similar to that of steps S808 and S309. That is, in step S409, the channel number ch is increased by one. In step S410, judgment is made as to whether the forced key-off process for channels being in key-off and being used for tone generation is finished for all channels from the channel number ch=1 to the channel number ch=16. When the forcedly key-off process is not yet finished, the procedure goes back to step S403 to repeat the process of steps S403 to S410. When the forcedly key-off process is finished, the procedure returns to the initial process (step S106 in FIG. 3).

As described above, in this embodiment, a musical tone resembling that of a natural musical instrument can be synthesized by not only changing a filter coefficient or coefficients corresponding to the touch but changing filter characteristic mainly based on the characteristic points of tone generation (for example, the characteristic point in key touch, the characteristic point in key release, and the like). An electronic musical instrument adapted for expressing fine control by a performer can be provided by using such a tone signal synthesizer.

It is a matter of course that this invention is not limited to the aforementioned embodiments and that changes thereof may be made.

Although the aforementioned embodiment has shown the case where a loop circuit substantially equivalent to the circuit disclosed in the Japanese Patent Publication (JP-B)No. Sho-58-58679 is used, the invention can be applied to the cases where another feedback loop composed of a filter and a delay circuit is used for a rubbed string model or a struck string model.

Although above description is made upon the case where the filter characteristic is changed once in time sequence for each of the key-on and the key-off, the invention can be applied to the case where the filter characteristic may be changed for two or more times.

Although above description is made upon the case where the change of the filter characteristic is realized by software means, the invention can be applied to the case where it may be realized by hardware means.

What is claimed is:

1. An electronic musical instrument employing a delayed feedback type tone signal synthesizer comprising:

key information generation means for generating key information including a key-on signal and a key-off signal;

performance information generation means for generating performance information other than the key information;

filter characteristic control means for generating a first filter coefficient based on the key-on signal and the performance information and a second filter coefficient different from said first filter coefficient based on the key-off signal and the performance information;

closed loop means for circulating a signal therein, including delay means for delaying the circulating signal and filter means for changing characteristics of the circulating signal in accordance with the first and second filter coefficients generated by the filter characteristic control means;

driving signal inputting means for generating a driving signal and for inputting the driving signal to the closed loop means; and output means for deriving a signal circulating in the closed loop means as a musical tone signal.

2. An electronic musical instrument of claim 1, wherein the key information further comprises key code information.

3. An electronic musical instrument according to claim 1, wherein the performance information comprises at least one of touch information expressing a strength of key operation and pedal information expressing manipulation of a pedal.

4. An electronic musical instrument according to claim 3, wherein the touch information comprises initial touch information and release touch information.

5. An electronic musical instrument according to claim 1, further comprising memory means for storing a plurality of filter coefficients, wherein the filter characteristic control means reads out the at least one filter coefficient from the plurality of filter coefficients.

6. An electronic musical instrument according to claim 1, further comprising selector means for selecting a driving signal based on the key information and the performance information.

7. An electronic musical instrument employing a delayed feedback type tone signal synthesizer comprising:

key information generation means for generating key information including a key-on signal and a key-off signal;

performance information generation means for generating performance information other than the key information;

filter characteristic control means for generating a first filter coefficient based on the key-on signal and the performance information upon key-on performance and a second filter coefficient based on the key-off signal and the performance information upon key-off performance;

closed loop means for circulating a signal therein, including delay means for delaying the circulating signal and filter means for changing characteristics of the circulating signal in accordance with the first and second filter coefficients generated by the filter characteristic control means;

driving signal inputting means for generating a driving signal and for inputting the driving signal to the closed loop means; and output means for deriving a signal circulating in the closed loop means as a musical tone signal.

8. An electronic musical instrument employing a delayed feedback type tone signal synthesizer comprising:

key information generation means for generating key information including a key-on signal and a key-off signal;

performance information generation means for generating performance information other than the key information;

filter characteristic control means for when said key-on signal is generated, generating a first filter coefficient based on the key information and the performance information upon key-on and for, when said key-off signal is generated, generating a second filter coefficient based on the key information and the performance information upon key-off;

closed loop means for circulating a signal therein, including delay means for delaying the circulating signal and filter means for changing characteristics of the circulating signal in accordance with the first and second filter coefficients generated by the filter characteristic control means, wherein the second filter coefficient has a value which increases a decay rate of the circulating signal;

driving signal inputting means for generating a driving signal and for inputting the driving signal to the closed loop means; and output means for deriving a signal circulating in the closed loop means as a musical tone signal.

* * * * *